US006093032A

United States Patent [19]

McHugh et al.

[11] Patent Number: 6,093,032

[45] Date of Patent: Jul. 25, 2000

[54] CONNECTOR WITH SPACER

[76] Inventors: Robert G. McHugh; Wen-Chun Pei, both of 930 W. Maude Ave., Sunnyvale, Calif. 94086

[21] Appl. No.: 08/955,769

[22] Filed: Oct. 22, 1997

[51] Int. Cl.[7] ..... H01R 9/09

[52] U.S. Cl. ..... 439/79

[58] Field of Search ..... 439/79, 59

[56] References Cited

U.S. PATENT DOCUMENTS

| | | | |
|---|---|---|---|
| 4,640,562 | 2/1987 | Shoemaker | 439/77 |
| 5,090,116 | 2/1992 | Henschen et al. | 29/827 |
| 5,096,428 | 3/1992 | Lwee et al. | 439/79 |
| 5,468,154 | 11/1995 | Yip et al. | 439/79 |
| 5,591,036 | 1/1997 | Doi et al. | 439/79 |
| 5,658,155 | 8/1997 | McFarlane et al. | 439/79 |
| 5,658,156 | 8/1997 | Henderson et al. | 439/79 |
| 5,688,130 | 11/1997 | Huang | 439/79 |
| 5,692,912 | 12/1997 | Nelson et al. | 439/79 |
| 5,713,746 | 2/1998 | Olson et al. | 439/79 |
| 5,785,537 | 7/1998 | Donahue | 439/79 |
| 5,863,222 | 1/1999 | Kinsey, Jr. et al. | 439/607 |

*Primary Examiner*—Khiem Nguyen
*Assistant Examiner*—Michael C. Zarroli

[57] ABSTRACT

A horizontal type card edge connector (10) includes an elongated insulative housing (12) defining a central slot (14) for receiving a module therein. Two rows of passageways (16) are provided by two sides of the central slot (14) in the housing (12) for receiving therein a corresponding number of contacts (18) which are adapted to be engaged with the corresponding circuit pads on the module. Two end blocks (20) disposed at two opposite ends of the housing (12), extend in both downward and rearward directions to define a space therebetween whereby the right angle type contact tails (30) are positioned in the space. A back shell (70) with an L-shaped cross-sectional configuration is attached to the back side of the housing (12) by two latch devices (76) intergrated therewith for protectively covering all the contact tails (30), wherein a horizontal wall (74) and a vertical wall (72) of the back shell (70) are respectively supported by top edge sections (81) and back edge sections (80) of the end blocks (20).

7 Claims, 3 Drawing Sheets

CONNECTOR WITH SPACER

BACKGROUND OF THE INVENTION

1. Field of the Invention

The invention relates to electrical connectors, and particularly to the electrical connector of a raised type having a spacer on the rear portion for aligning contact tails 2. The Related Art A spacer device is popularly used with the connector for alignment of the contact tails with the corresponding holes in the PC board on which the connector is mounted, for example, U.S. Pat. Nos. 5,658,155 and 5,658,156. Most spacers are used with the common connectors which are generally closely seated on the PC board. Thus, differently an object of the invention is to provide a raised connector with its own unique structure for cooperation with the spacer.

SUMMARY OF THE INVENTION

According to an aspect of the invention, a horizontal type card edge connector includes an elongated insulative housing defining a central slot for receiving a module therein. Two rows of passageways are provided by two sides of the central slot in the housing for receiving therein a corresponding number of contacts which are adapted to be engaged with the corresponding circuit pads on the module. Two end blocks disposed at two opposite ends of the housing, extend in both downward and rearward directions to define a space therebetween whereby the right angle type contact tails are positioned in the space. A back shell is attached to the back side of the housing for protectively covering all the contact tails thereunder. A spacer is provided on the rear portion of the housing and retainably sandwiched between the two end blocks wherein a plurality of holes extend therethrough in the vertical direction for aligning the contact tails with regard to the corresponding holes in the board.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
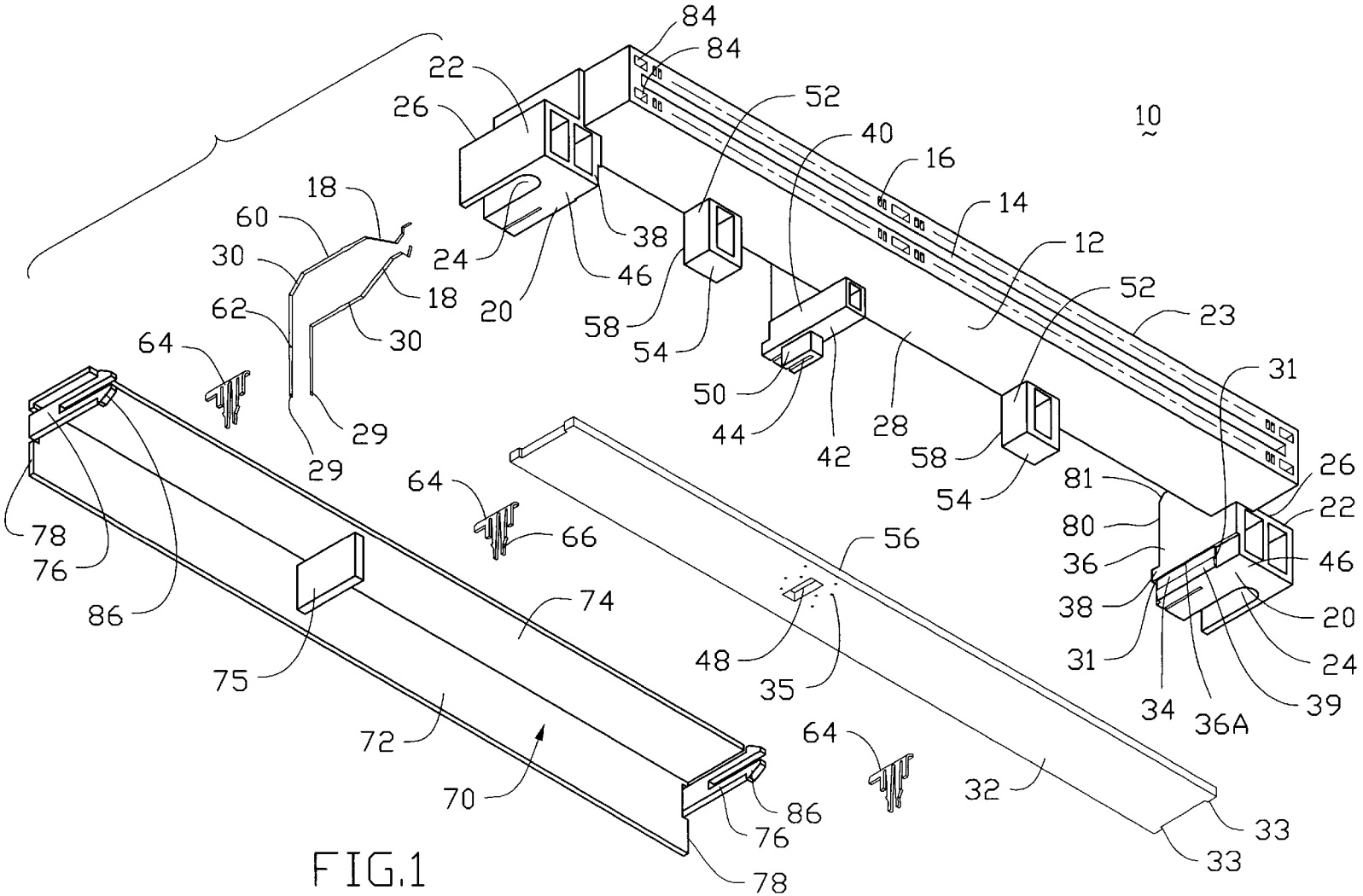
FIG. 1 is an exploded bottom perspective view of a presently preferred embodiment of a horizontal type electrical connector, according to the invention.
Figure 2:
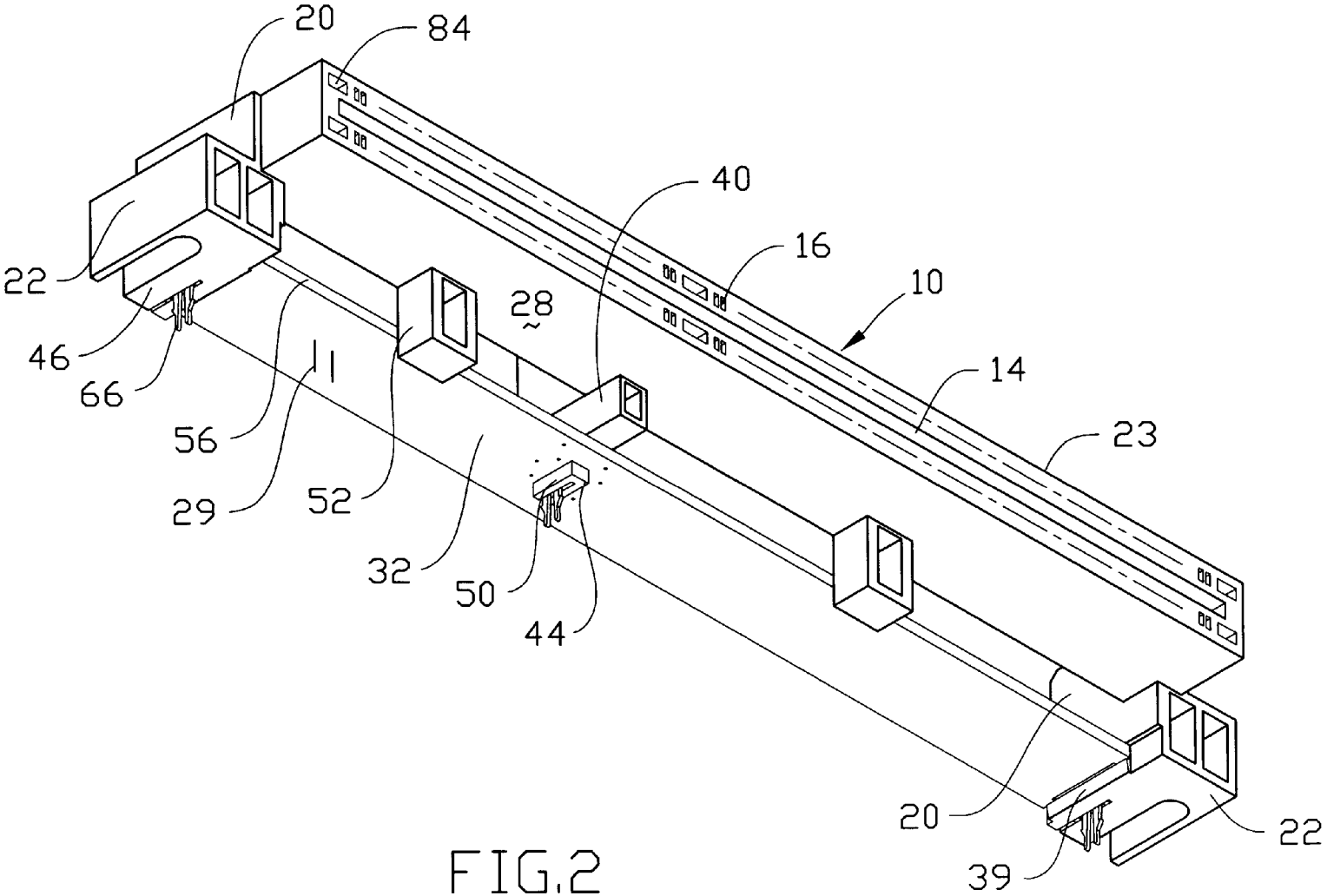
FIG. 2 is a bottom perspective view of the assembled connector of FIG. 1.
Figure 3:
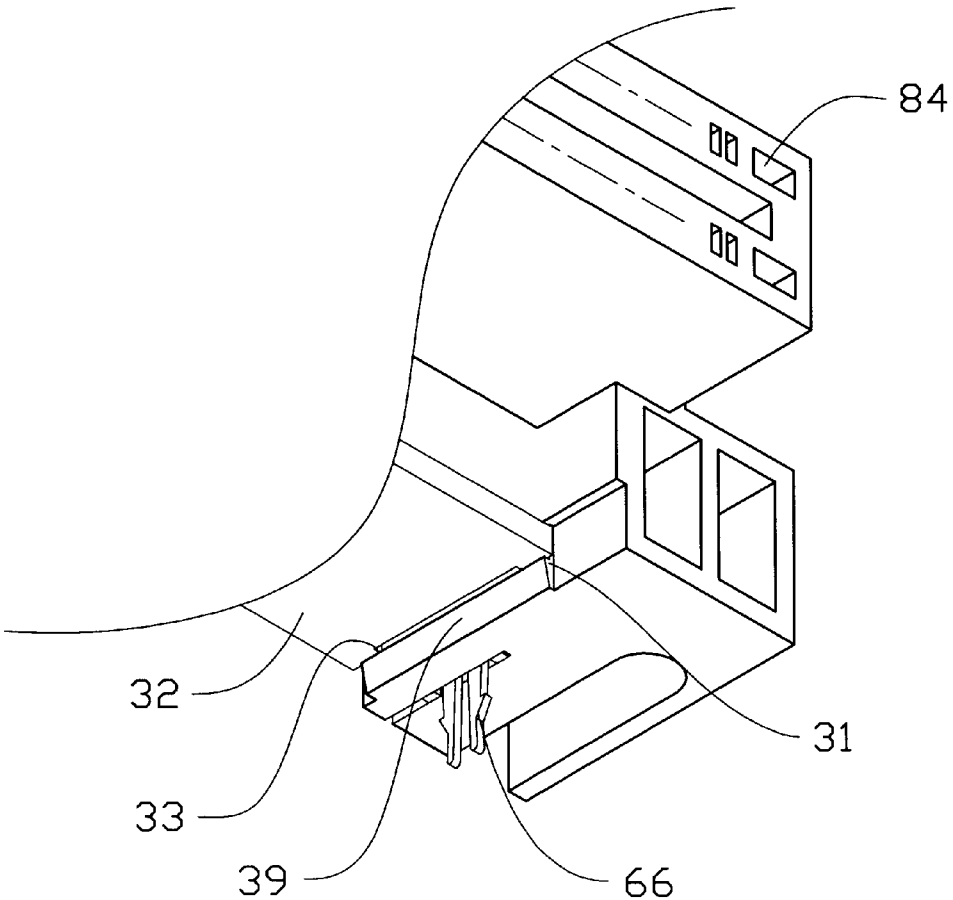
FIG. 3 is a partial enlarged perspective view of the assembled connector of FIG. 2.

It will be noted here that for a better understanding, most of like components are designated by like reference numerals throughout the various figures in the embodiments. Attention is directed to FIGS. 1–3 wherein a horizontal type electrical connector 10 includes an insulative elongated housing 12 defining a central slot 14 along its longitudinal direction for receiving a module (not shown) therein. Provided by two sides of the central slot 14 are two rows of passageways 16 extending through the housing 12 in a front-to-back direction for receiving a corresponding number of contacts 18 therein, respectively.

A pair of end blocks 20 are positioned at two opposite ends of the housing 12. Each end block 20 extends downward and rearward so that the bottom surface 28 of the main body 23 of the housing 12 is spaced from a PC board (not shown), on which the connector 10 is seated, in a distance generally equal to the height of the main body 23 of the housing 12 for facilitating insertion of a CPU module (not shown) from a horizontal direction into the central slot 14 of the housing 12. Each end block 20 further includes an outward horizontal extension 22 defining a screw hole 24 therein for allowing a screw (not shown) to extend therethrough and into the corresponding hole of a PC board (not shown) for securing the connector 10 to the PC board, wherein the top surface 26 of the extension 22 is generally at the same level with the bottom surface 28 of the main body 23 of the housing 12. Thus, the block 20 with the associated extension 22 function as a standoff with regard to the housing 12 of the connector 10.

Because the housing 12 of the horizontal type connector 10 has been raised away from the PC board with a substantial distance generally equal to the height of the main body 23 of the housing 12, the contact tail 30 of each contact 18 extends downward longer than the conventional one, which is substantially close to the PC board, for reaching the PC board below. Accordingly, a spacer 32 is designedly disposed adjacent a bottom surface 46 of the end blocks 20 and substantially in the space between the two blocks 20. To efficiently retain the spacer 32 in position regard to the blocks 20, a pair of shallow member 34 are formed on the inner surface 36 of the bottom portion 38 of the end blocks 20, respectively. Additionally, to easily assemble the spacer 32 to the end blocks 20 in position, a tapered surface 39 is provided on the lower portion of the inner surface 36 of the block under the corresponding shallow member 34.

Additionally, because the spacer 32 extends along the longitudinal direction of the housing 12 and the lengthwise dimension of the spacer 32 is relatively much larger than the width of the spacer 32, thus tending to be deflected around the middle portion thereof, an auxiliary block 40 is provided on the rear portion of the housing 12 extending to a bottom portion thereof, whereby the spacer 32 may abut against a under-surface 42 of the auxiliary block 40. The auxiliary block 40 also includes a bottom surface 44 in coplanarity with the bottom surfaces 46 of the end blocks 20 for functioning as an additional standoff 50 for supportably mounting the connector 10 unto the PC board. It can be seen that the spacer 32 includes an alignment aperture 48 defined between two ends thereof to allow the standoff 50 to downward extend therethrough from the under-surface 42 of the auxiliary block 40 to the PC board. From another viewpoint, the standoff 50 also functions as an alignment device for cooperation with the alignment aperture 48 for quickly and precisely helpfully leading the spacer 32 to approach its final vertical position, from the bottom, with regard to the blocks 20.

To assure the spacer 32 be securely retained with regard to the blocks 20 in position in the front-to-end direction, the housing includes a pair of steps 31 adjacent two opposite end of the shallow members 34 to cooperate with a pair of corresponding shoulders 33 on the spacer 32. Thus, each shoulder 33 of the spacer 32 can be wiped through the tapered surface 39 and properly positioned in the shallow member 34 with regard to the blocks 20 in the front-to-end direction.

A boardlock 64 is positioned in each block 20, 40 with an engagement section 66 extends downward out of the corresponding bottom surface 44, 46 of the block 40, 20 for engagement within the corresponding boardlock hole (not shown) in the board 100.

To achieve a more balanced arrangement along the longitudinal direction of the housing 12, two additional standoffs 52 are provided under the bottom surface 28 of the main body 22 of the housing 12 wherein each is positioned between the auxiliary block 40 and one corresponding end block 20 and has a bottom surface 54 in coplanarity with the bottom surface 46 of the end block 20. The front edge 56 of the spacer 32 confronts the back surface 58 of the standoff 52.

The contact tail 30 is of a right angle type extending out of the housing 12 and generally positioned in the space between the two end blocks 20. Specifically, the contact 18 has a contacting portion (not labeled) firmly received in the housing 12 and an L-shaped contact tail 30 extending out of the housing 12 and having a horizontal section 60 extending out of the housing 12 and a vertical section 62 substantially perpendicular to the horizontal section 60. An L-shaped cross-sectional shell 70 is provided to protectively cover the contact tail 30 from top and rear sides thereof preventing the latter from exposing to external from the top and rear orientations.

The shell 70 includes a vertical wall 72 and a horizontal wall 74 to form the L-shaped cross-sectional configuration. The 25 shell 70 is generally seated on the end blocks 20 and the auxiliary block 40 wherein the horizontal wall 74 abuts against the top edges 81 of the blocks 20, 40, and the vertical wall 72 abuts against the back edges 80 of the blocks 20, 40. To guide the shell 70 to be attached to the blocks 20, 40 of the housing 12, the vertical wall 72 includes an alignment post 75 extending forward for reception within a corresponding slot (not shown) in the auxiliary block 40. To fasten the shell 70 to the blocks 20 of the housing 12, a pair of latches 76 extend forward from two end edges 78 of the vertical wall 72 for latchable engagement within a pair of cavities 84 provided in the respective end blocks 20. A step (not shown) is formed in the cavity 84 for locking the inserted hook section 86 of the latch 76 thereof. The detailed of the shell 70 related to the housing 12 may be referred to U.S. patent application Ser. No. 08/955,444 of which the inventors and the assignee are the same to those of the present invention.

Therefore, after the contacts 18 have been assembled into the corresponding passageways 16, with the contact tails 30 extending out of the rear face of the housing 12 substantially positioned between the end blocks 20, the shoulders 33 of the spacer 32 are then snapped into the two shallow members 34 of the end blocks 20. A section of each tip 29 of the contact tail 30 is restrained within the corresponding hole 35 of the spacer 32 for maintaining the true positions thereof. The shell 70 is fastened to the blocks 20, 40 of the housing 12 from the rear face thereof and the alignment post 75 is guidably inserted into the corresponding slot and the latches 76 are received within the cavities 84, with the hook sections 86 thereof being latchably engaged with steps (not shown) in the cavity 84.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for mounting on a PC board comprising:

an insulative elongated housing with a plurality of contacts having corresponding tails thereof extending out of the housing;

a pair of end blocks extending rearward and downward at two opposite ends of the housing defining a first space therebetween for accommodating said contact tails;

an elongated spacer positioned in said space with a plurality of holes therein for aligning contact tails in a vertical direction; and an auxiliary block positioned between said pair of end blocks for supporting engagement with the spacer;

wherein said auxiliary block includes an alignment device extending downward for engagable reception within an alignment aperture in the spacer so that the spacer can be easily assembled to the housing.

2. The connector as claimed in claim 1, wherein each end block includes a shallow member with two opposite steps aside for retainable engagement with a pair of shoulders and an end edge of the spacer.

3. The connector as claimed in claim 1, wherein said housing further includes at least a standoff positioned between the end blocks whereby a front edge of the spacer can abut against said standoff.

4. An electrical connector including:

an elongated housing with therein a plurality of contacts wherein contact tails of said contacts extend downward out of a bottom surface of the housing;

a pair of end blocks generally positioned adjacent two opposite ends of the housing and defining a space therebetween to accommodate said contact tails therein;

a spacer defining a plurality of holes therein for passage of said contacts therethrough; wherein each end block includes a shallow member with two steps aside for cooperation with an end edge with two shoulders aside of the spacer so that each shoulder of the spacer can be retainably attached to the shallow member of the end block.

5. The connector as defined in claim 4, wherein the spacer further includes an alignment aperture defined between two ends thereof for alignment with an alignment device extending downward from the housing so as to prevent vertical deflection of the spacer thereabouts.

6. An electrical connector for mounting on a PC board comprising:

an insulative elongated housing with a plurality of contacts having corresponding tails thereof extending out of the housing;

a pair of end blocks extending rearward and downward at two opposite ends of the housing defining a first space therebetween for accommodating said contact tails;

an elongated spacer positioned in said space with a plurality of holes therein for aligning contact tails in a vertical direction; and an auxiliary block positioned between said pair of end blocks for supporting engagement with the spacer; wherein each end block includes a shallow member with two opposite steps aside for retainable engagement with a pair of shoulder and an end edge of the spacer.

7. An electrical connector for mounting on a PC board comprising:

an insulative elongated housing with a plurality of contacts having corresponding tails thereof extending out of the housing;

a pair of end blocks extending rearward and downward at two opposite ends of the housing defining a first space therebetween for accommodating said contact tails;

an elongated spacer positioned in said space with a plurality of holes therein for aligning contact tails in a vertical direction; and an auxiliary block positioned between said pair of end blocks for supporting engagement with the spacer; wherein said housing further includes at least a standoff positioned between the end blocks whereby a front edge of the spacer can abut against said standoff.

* * * * *